United States Patent [19]

Schmeltz

[11] Patent Number: 5,033,127

[45] Date of Patent: Jul. 23, 1991

[54] TRANSFORMABLE ARTICLE OF CLOTHING, SUCH AS TROUSERS, JACKET, GLOVE

[76] Inventor: Jean-Claude Schmeltz, Rësidence "Le Brëvent", 74400-Chamonix, France

[21] Appl. No.: 378,572

[22] PCT Filed: Oct. 21, 1988

[86] PCT No.: PCT/FR88/00515

§ 371 Date: Jun. 19, 1989

§ 102(e) Date: Jun. 19, 1989

[87] PCT Pub. No.: WO89/03643

PCT Pub. Date: May 5, 1989

[30] Foreign Application Priority Data

Oct. 23, 1987 [FR] France ..... 87 14699

[51] Int. Cl.[5] ..... A41B 27/10

[52] U.S. Cl. ..... 2/269; 2/125

[58] Field of Search ..... 2/269, 126, 70, 85, 2/93, 97, 108, 123, 124, 125, 243 R, 270, 272

[56] References Cited

U.S. PATENT DOCUMENTS 3,665,516 5/1972 Orovan ..... 2/269
4,068,316 1/1978 Haywood ..... 2/269
4,543,670 10/1985 Ehring ..... 2/269
4,573,218 3/1986 Saggs ..... 2/269

FOREIGN PATENT DOCUMENTS 2153187 5/1973 Fed. Rep. of Germany .
2601859 1/1988 France .
2164541 3/1986 United Kingdom .

*Primary Examiner*—Werner H. Schroeder
*Assistant Examiner*—Gloria Hale
*Attorney, Agent, or Firm*—McAulay Fisher Nissen Goldberg & Kiel

[57] ABSTRACT

A transformable article of clothing having a tubular element and an extensible tubular member to provide for a lengthening effect of the tubular element; the extensible tubular member is fixed to the interior of the tubular element so as to extend freely from the inside of the tubular element and includes three sleeves joined together. One sleeve is an upper sleeve which is joined to a lower sleeve through an intermediate sleeve by a first rapid-fastening device. The intermediate sleeve includes two tubular sections joined to each other in a separable manner by a second rapid-fastening device with one section being joined to the lower sleeve, the second section being joined to the upper sleeve, so that the lower sleeve can be changed in color, removed, lengthened or shortened.

16 Claims, 1 Drawing Sheet

TRANSFORMABLE ARTICLE OF CLOTHING, SUCH AS TROUSERS, JACKET, GLOVE

BACKGROUND OF THE INVENTION

1. Field of the Invention

The present invention relates to a transformable article of clothing, such as trouser, jacket, glove, etc.

2. Description of the Prior Art

Transformable articles of clothing are already known, which may in particular be lengthend to adapt to various conditions of use or to growth of the wearer. Such a transformable article is for example described in German Patent No. DE-A-2 153 187. In this Patent, it is indicated that a sleeve of a coat may comprise two parts joined to each other via a zipper and an inner linking piece which may be unfolded in order to show a reflecting element.

SUMMARY OF THE INVENTION

The present invention relates to improvements made to this type of article for the purpose of increasing the domains of use of the article and of altering its appearance very substantially in accordance with the desirata of the wearer of the article of clothing.

To that end, this transformable article of clothing, such as trouser, jacket, etc., comprises a tubular element such as a trouser leg, sleeve, terminating in an opening, comprises, inside the end part of the tubular element which is close to its opening, an extensible tubular member comprising an upper, a lower and an intermediate sleeve member, the upper sleeve member being fixed to the interior of the outer tubular element, particularly by sewing, solely along an upper edge of the upper sleeve member so that the tubular member extends freely from the inside of the tubular element and with a lower edge of the lower sleeve member projecting outside of the tubular element, depending, or course, on the length of the tubular member, and the three sleeves are joined together, by a first rapid-fastening device, such as a zipper. The intermediate sleeve itself comprises two tubular sections joined to each other in a separable manner by a second rapid-fastening device, such as a zipper, the first section of the intermediate sleeve having an upper edge joined to a lower edge of the upper sleeve whilst the second section of the intermediate sleeve has a lower edge joined to an upper edge of the lower sleeve, The extensible tubular member of the transformable article of clothing according to the invention may thus be in two different states, namely a non-extended state in which the extensible tubular member having its smallest length, projects slightly from the opening of the outer tubular element, and a lengthened or extended state in which the lower sleeve projects virtually completely outside of the tubular element. In the extended or lengthened state, the tubular element gives the appearance of being extended over a certain length by the lower sleeve which extends below the bottom edge of the tubular element and may present an appearance and/or different colour to give the assembly of the article of clothing a different appearance.

An embodiment of the present invention will be described hereinafter by way of non-limiting example, with reference to the accompanying drawings, in which:

Figure 1:
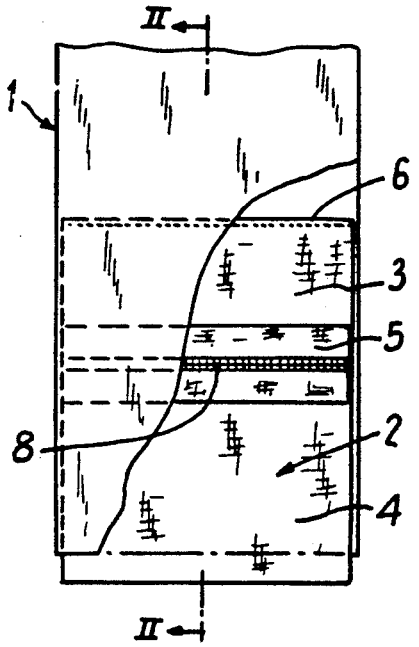
FIG. 1 is a view in elevation, with parts torn away, of a trouser leg transformable according to the invention, in the non-extended state.

In the drawings, there is shown a tubular element, or member 1 of a transformable article of clothing constituted, in the present case, by trouser. In this case, the tubular element or member 1 constitutes or exemplities a trouser leg, and the trouser leg has a length determined once and for all during manufacture thereof.

According to the invention, the trouser leg 1 comprises, inside its end part close to its lower opening, an extensible tubular element 2 which is constitute by three tubular sections or sleeves, or a member composed of three layers. The first tubular section or sleeve is an upper sleeve 3, the second tubular section or sleeve is a lower sleeve 4, and the third tubular section or sleeve is an intermediate sleeve 5. The upper sleeve 3 is completely housed inside the trouser leg 1 and upper sleeve 3 at the upper edge thereof is joined, along its upper edge to the inside of trouser leg 1, by a seam 6. Consequently, the assembly of the extensible tubular element 2 and upper sleeve 3 hang freely inside the trouser leg 1, from the upper edge of upper sleeve 3 joined by the seam 6. Tubular element 2 has an extended state and a non-extended state. The state of tubular element 2 illustrated in FIGS. 1 to 3 is the non-extended state and, it that case, the lower sleeve 4 projects slightly below the bottom portion of trouser leg 1, so that the lower end part of lower sleeve 4 is below the lower opening of the trouser leg 1.

Figure 2:
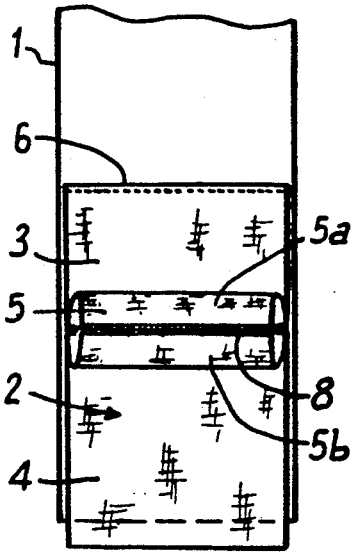
FIG. 2 is a view in section taken along line II—II of FIG. 1.
Figure 3:
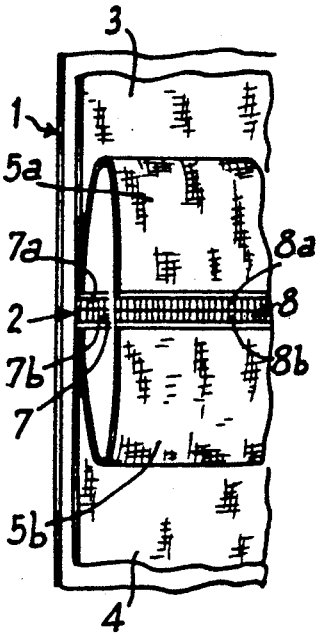
FIG. 3 is a partial view in vertical section, on a larger scale, of the trouser leg, in the non-extended state.

In the non-lengthened or non-extended state shown in FIGS. 1 to 3, the lower edge of the upper sleeve 3 and the upper edge of the lower sleeve 4 are joined together by means of a first rapid-fastening device 7 which may advantageously be constituted by a zipper having two parts *7a* and *7b* each having teeth which mesh together when the zipper is closed and which are separated when the zipper is opened. The two parts *7a*, *7b* of this zipper are respectively sewn to the two edges of the two sleeves 3, 4 having to be joined together. Edge *7a* of zipper 7 is connected with a lower edge or margin portion of upper sleeve 3 which is the other edge of upper sleeve 3 and is the edge that is sewn to trouser leg 1. Edge *7a* of zipper 7 is also connected with an upper edge of the intermediate sleeve 5, and the upper edge of intermediate sleeve 5, the lower edge of upper sleeve 3 and edge *7a* of zipper 7 form one connector. Another connector is formed by the other edge *7b* of zipper 7, a lower edge of intermediate sleeve 5, and an upper edge of lower sleeve 4; the other edge *7b*, the lower edge of intermediate sleeve 5 and the upper edge of lower sleeve 4 are connected together as a unit to form the other connector. The lower edge of lower sleeve 4 is opposite to the upper edge or upper margin of lower sleeve 4, and it is the lower edge of lower sleeve 4 which extends outside of and below the trouser leg 1. The upper and lower edges of the intermediate sleeve 5 are also sewn, to the parts *7a*, *7b* of the zipper 7. More particularly, the upper edge of the intermediate sleeve 5 is sewn to the upper part *7a* of the zipper 7, jointly with the lower edge of the upper sleeve 3. In the same way, the lower edge of the intermediate sleeve 5 is sewn to the lower part *7b* of the zipper 7, jointly with the upper edge of the lower sleeve 4. In the non-lengthened state, the upper and lower edges of the intermediate sleeve 5 are therefore fastened at the location of the zipper 7 then closed, so that the intermediate sleeve 5 is folded on itself and presents a cross section in the form of a closed loop.

The intermediate sleeve 5 is constituted by two sections, upper *5a* and lower *5b* which are joined together by a second rapid-fastening device 8 such as a zipper.

When considering the specific embodiment in which the intermediate sleeve 5 is formed of two sections connected together by rapid-fastening device 8, upper section *5a* is the section releasably connected with upper sleeve 3. Specifically, the upper edge of intermediate section 5 is also the upper edge of the upper section *5a* which is connected with upper part *7a* of zipper 7, and the lower edge of intermediate section 5 is also the lower edge of lower section *5b* which is connected with lower part *7b* of zipper 7 which is connected with the upper edge of lower sleeve 4.

The intermediate sleeve 5, when divided into upper section *5a* and lower section *5b*, each forms two separate tubular elements with marginal edges. Specifically, upper section *5a* includes an upper edge and a lower edge, the upper edge of upper section *5a* being the same as the upper edge of section 5, and the lower edge forms a first joinder member to cooperate with zipper 8. The lower section *5b* also includes a lower edge and an upper edge. The lower edge of lower section *5b* is the same as the lower edge of intermediate section 5 joined with the upper edge of lower section 4, and the upper edge of section *5b* is a second joinder member to cooperate with zipper 8 and in a closed or zippered condition of zipper 8 is joined to the lower edge of section *5a* and in the open or unzippered condition of zipper 8 is separated from section *5a*.

The rapid-fastening device 8 may also be considered to be an inner tubular element changer and form first and second intermediate sleeve connectors for connecting the sections *5a* and *5b* together to form the intermediate sleeve 5 as a unit. More particularly, the lower edge of the upper section *5a* of sleeve 5 is joined to the upper part *8a* of the zipper 8, whilst the upper edge of the lower section *5b* of the sleeve 5 is joined to the lower part *8b* of the zipper 8.

Figure 4:
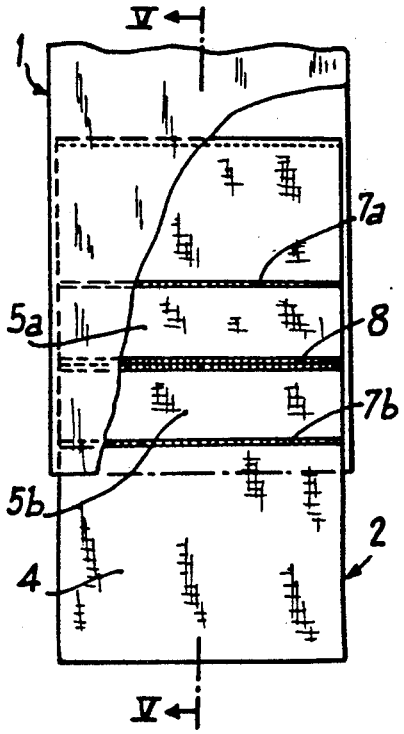
FIG. 4 is a view in elevation of the trouser leg in the lengthened state with parts removed or torn away.
Figure 5:
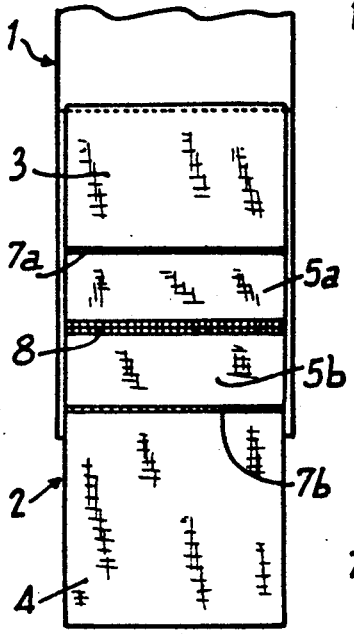
FIG. 5 is a view in vertical section taken along line V—V of FIG. 4.
Figure 6:
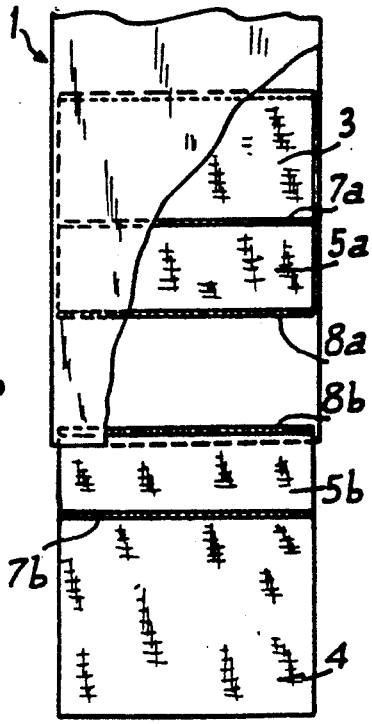
FIG. 6 is another view in elevation, with parts torn away, of the trouser leg, illustrating the replacement of the outer sleeve of the extensible tubular element.

The trouser leg 1 as thus adapted according to the invention may easily be transformed by passing from the non-lengthened state or non-extended state shown in FIGS. 1 to 3 into the lengthened state or extended shown in FIGS. 4 to 6. In the non-lengthened state, the lower sleeve 4 of the extensible tubular element 2 which is housed inside the trouser leg 1, projects slightly below the latter, as shown in FIGS. 1 to 3, and does not substantially alter the appearance of the trouser leg 1. In order to transform the appearance of the trouser leg 1 by lengthening it, it suffices to open the first zipper 7 so as totally to separate the two parts *7a*, *7b* of this zipper 7 from each other. Consequently, the intermediate sleeve 5 unfolds vertically, this provoking an extension of the extensible tubular element 2 and allowing the lower sleeve 4 to extend further below the bottom edge of trouser leg 1. In the lengthened state as shown in FIGS. 4 to 6, the lower sleeve 4 projects virtually completely below the opening of the trouser leg 1. The lower sleeve 4 is still joined to the lower section *5b* of the intermediate sleeve 5, being sewn, jointly with the latter, with the part *7b* of the zipper 7. The trouser leg as thus transformable lends itself easily to a modification of its appearance in the lower part. In fact, it suffices and it is possible to replace the lower sleeve 4 with another lower sleeve 4 made in the same manner and presenting an appearance and/or different colour. For this replacement, it suffices to open the second zipper 8, so as to separate these two parts *8a*, *8b* from each other as shown in FIG. 6 and to separate sections *5a* and *5b* of intermediate sleeve 5. The lower outer sleeve 4 and a portion of intermediate sleeve 5, the lower section *5b* of intermediate sleeve 5 may then be totally detached and replaced by another sleeve to form the lower sleeve 4, provided in the same manner with a lower section *5b* and a zipper part *8b* which allows connection with the other part *8a* which, itself, has remained in place inside the trouser leg 1.

I claim:

1. A transformable article of clothing having an outer tubular element terminating in an opening, comprising:

a tubular member positioned within said tubular element and comprising an upper sleeve member, a lower sleeve member and an intermediate sleeve member;

means for connecting said tubular member to said tubular element so that said tubular member extends freely from an outer edge of said tubular element;

said upper sleeve member having an upper edge and a lower edge positioned within an end part of said tubular element, and said coupling means connecting said upper edge of said upper sleeve to an inner portion of said tubular element;

said lower sleeve member having an upper edge and a lower edge, and said intermediate sleeve member having an upper edge and a lower edge;

means for coupling said sleeve members together, said coupling means including a first rapid-fastening device comprising first and second edge connections, first means for joining said first edge connector, said lower edge of said upper sleeve and said upper edge of said intermediate sleeve together and forming a first connection member, and second means for joining said second edge connector, said upper edge of said lower sleeve and said lower edge of said intermediate sleeve together and forming a second connection member, and means for connecting and disconnecting said first and said second connection members to each other and from each other, respectively to increase and decrease the length of said tubular member; and connection means comprising a second rapid-fastening device comprising first and second edge connectors and means for connecting said last-mentioned edge connectors together;

said intermediate sleeve member comprising an upper tubular section and a lower tubular section, said upper tubular section including a lower edge and said upper edge of said intermediate sleeve member, and said lower tubular section including an upper edge and said lower edge of said intermediate sleeve member; and means joining the first edge connector of said second rapid-fastening device and the lower edge of said upper tubular section together to form a first intermediate sleeve connector, means joining the second edge of said second rapid-fastening device and the upper edge of said lower tubular section together to form a second intermediate sleeve connector, and said means for connecting the first and the second edge connectors of said second rapid-fastening device together including means for connecting and disconnecting said first intermediate sleeve connector and said second intermediate sleeve connector for connecting said upper and said lower tubular sections to each other and separating them from each other, respectively.

2. The article of clothing according to claim 1, wherein the two edges of said intermediate sleeve are respectively sewn, jointly with the edges of said upper and said lower sleeves, to said first and said second edge connectors.

3. The article of clothing as claimed in claim 1, wherein said means for connecting said tubular member to said tubular element includes seam means for connecting the upper edge of said upper sleeve to said tubular element.

4. The article of clothing as claimed in claim 3, wherein said seam means connects said upper edge of said upper sleeve to said tubular element.

5. The article of clothing as claimed in claim 1, wherein said first and second joining means includes seam means.

6. The article of clothing as claimed in claim 1, wherein said first rapid-fastening device includes a zipper.

7. The article of clothing as claimed in claim 1, wherein said second rapid-fastening device includes a zipper.

8. The article of clothing as claimed in claim 6, wherein said second rapid-fastening device includes a zipper.

9. The article of clothing as claimed in claim 8, wherein said means for connecting said tubular member to said tubular element includes seam means for connecting the upper edge of said upper sleeve to said tubular element.

10. The article of clothing as claimed in claim 5, wherein said sewing means connects said upper edge of said upper sleeve to said tubular element.

11. The article of clothing according to claim 1, wherein the lower edge of said upper sleeve member and the upper edge of said intermediate sleeve member are sewn together.

12. The article of clothing according to claim 1, wherein the lower edge of said intermediate sleeve member and the upper edge of said lower sleeve member are sewn together.

13. The article of clothing according to claim 3, wherein the lower edge of said upper sleeve member and the upper edge of said intermediate sleeve member are sewn together.

14. The article of clothing according to claim 3, wherein the lower edge of said intermediate sleeve member and the upper edge of said lower sleeve member are sewn together.

15. The article of clothing according to claim 13, wherein the lower edge of said intermediate sleeve member and the upper edge of said lower sleeve member are sewn together.

16. The article of clothing according to claim 1, wherein said coupling means includes sewing along the upper edge of said upper sleeve for fixing said tubular member interiorly of said tubular element.

* * * * *